United States Patent [19]

Maguire et al.

[11] Patent Number: 5,067,639

[45] **Date of Patent: * Nov. 26, 1991**

[54] POURING SPOUT WHICH CAN BE SELECTIVELY OPENED AND CLOSED

[76] Inventors: Paul R. Maguire, 4284 Sea View La., Los Angeles, Calif. 90065; John M. Lown, 222 La Jolla La., Newport Beach, Calif. 92663

[ * ] Notice: The portion of the term of this patent subsequent to Mar. 19, 2008 has been disclaimed.

[21] Appl. No.: 621,995

[22] Filed: Dec. 4, 1990

Related U.S. Application Data

[63] Continuation-in-part of Ser. No. 413,185, Sep. 27, 1989, Pat. No. 5,000,360.

[51] Int. Cl.[5] ..... B67D 5/72

[52] U.S. Cl. ..... 222/521; 222/568

[58] Field of Search ..... 222/519–520, 222/566–571, 528–532, 537–539, 478, 481

[56] References Cited

U.S. PATENT DOCUMENTS 5,000,360 3/1991 Lown et al. ..... 222/568

FOREIGN PATENT DOCUMENTS 943452 12/1963 United Kingdom ..... 222/521

*Primary Examiner*—Kevin P. Shaver

*Attorney, Agent, or Firm*—Harold L. Jackson

[57] ABSTRACT

A pouring spout which can be selectively opened or closed to pass materials therethrough. The spout includes a threaded end which is adapted to engage a container, a spout body for conducting the materials from the container and an adjustable end which is adapted to selectively interrupt the flow of materials through the spout.

14 Claims, 2 Drawing Sheets

POURING SPOUT WHICH CAN BE SELECTIVELY OPENED AND CLOSED

RELATED APPLICATION

This is a continuation in part of application Ser. No. 413,185, filed Sept. 27, 1989, now U.S. Pat. No. 5,000,360.

BACKGROUND OF THE INVENTION

1. Field of the Invention

This invention is directed to a pouring spout, in general, and to a pouring spout which can be selectively opened or closed to interrupt the flow of materials through the spout, in particular.

2. Prior Art

There are many types of spouts known in the prior art. These include pouring spouts which can be inserted into containers to conduct the contents thereof from the container. Typical of this type of spout is the oil-can spout which is inserted into the oil-can by puncturing the top thereof.

Other spouts include spouts which are integrally involved with the container. Typical of such spouts are the pull-up spouts associated with salt containers or the like.

Many containers such a gasoline containers or the like include spouts or hoses which can be attached to the container by means of a threaded end.

Some spouts such as those used with faucets or funnels, include valves therein, normally a ball-valve or the like, which can selectively interrupt the flow through the spout.

However, most of these components have shortcomings in one or more areas of utilization. For example, a valved funnel, typically, does not include a threaded end. The faucet-type spout does not include a spout which is readily detachable from a container (or source of materials). The oil-can spout causes or permits dripping of product.

In the current age of do it yourself operations, especially in maintenance of automobiles or similar vehicles, the owner of the vehicle frequently has to insert fluids into the appropriate location. This can include, for example, oil into the crankcase; anti-freeze into the radiator; battery fluid into the battery; and/or brake fluid into a master cylinder. Of course, other fluids or substances can be added to other areas of the vehicle. The listing above is not intended to be limitative or all inclusive.

In performing these tasks, many of the containers which are now utilized for containing oil, anti-freeze, brake fluid or the like come in containers which have a threaded neck. These containers are frequently formed of plastic and/or metal. The conventional method of utilization is to remove the cap form the container and pour the contents into the vehicle receptacle directly or through funnel. In the case of the oil-can spout of the "puncture-type", the spout operates in a similar fashion.

However, it is well known that in performing any of these tasks, a substantial margin for error exists and product from the container is dripped or spilled during the process. In the instances where funnels are used, it is often difficult to gauge the capacity of the receptacle wherein excessive material is supplied to the funnel and spilled on the floor or on the vehicle engine. Other similar problems occur frequently consequently, it is highly desirable to provide an improved spout which is adapted to engage with the container and to selectively permit closure of the spout so that a controlled amount of material can be transferred from the container to the receptacle.

SUMMARY OF THE INSTANT INVENTION

This invention is directed to a spout which is adapted to be attached to a container and which permits selective opening or closing thereof.

In the preferred embodiment, the spout includes three major components which are joined together by a snap-on connection arrangement. The main spout body is a slightly arcuate tube or cylinder. A threaded cap arrangement is adapted to snap onto one end of the spout body A stepped down, funnel-like end is adapted to snap onto the other end of the spout body. The cap and the associated end of the spout body are arranged to interact through a connection which is completely free to rotate but capable of sealing to this container. The funnel-like end interacts with the spout body through a camming arrangement wherein a stopper device (usually joined to the spout body) selectively engages the funnel-end so as to block flow therethrough.

PRIOR ART STATEMENT

The listed patents were uncovered in a preliminary patentability search. The patents are listed in descending numerical order; no other significance is intended.

U.S. Pat. No. 4,705,192; REUSABLE MULTI-COMPARTMENT CONTAINER WITH CHARGING AND DISCHARGING MEANS; P. Knapton. This patent is directed to a container for storing a plurality of substance and includes a flow-directing funnel.

U.S. Pat. No. 4,600,125; LIQUID FUNNEL AND POURING SPOUT COMBINATION; W. Maynard, Jr. The patent is directed to a pouring device with a primary funnel (with a container piercing element), as well as secondary and tertiary spout extensions for reaching relatively inaccessible receptacles. A closure plug fits all of the spouts.

U.S: Pat. No. 4,583,668; POURING SPOUT FOR DIVERSE LIQUID CONTAINERS; W. Maynard, Jr. The patent is directed to a threaded, elongated pouring spout which is connectable to different size containers.

U.S Pat. No. 4,217,940; FUNNEL HAVING AN INTEGRAL POURING SPOUT; M. Wheeler. This patent is directed to a funnel having an integral pouring spout attached to the inner surface of the funnel.

U.S. Pat. No. 2,782,967; SCREW-ON POURING SPOUT; R. Walker. This patent is directed to a replacement cap for a container which operates as a pouring spout without redesign of the container.

U.S. Pat. No. 2,556,627; ADAPTER FOR FUEL CAN SPOUT FOR ACCOMMODATION OF NOZZLES OF DIFFERENT DIAMETERS; R. Miksis. This patent is directed to a dispensing spout which can be used interchangeably on fluid container and includes a stepped socket with different diameters.

U.S Pat. No. 216,530; MEASURING FUNNEL; J. Pfitzenmeier. This patent is directed to a funnel formed of several sections with increasing diameter.

DESCRIPTION OF THE PREFERRED EMBODIMENT

Throughout this description, common components bear the same numerals.

Figure 1:
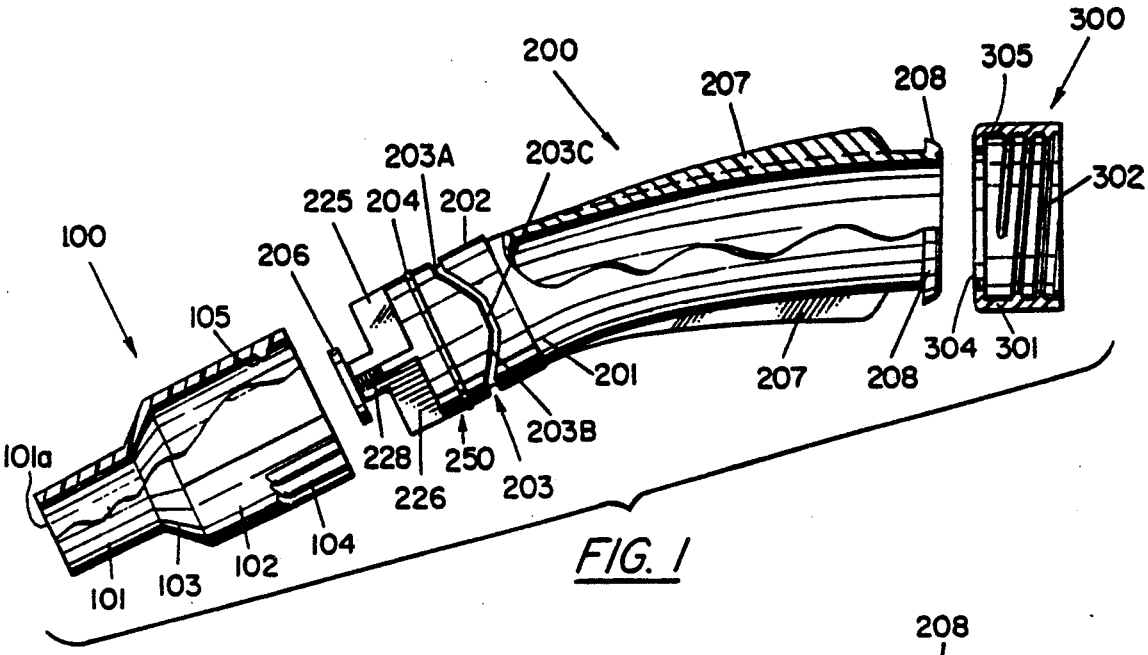
FIG. 1 is a partially broken away, partially sectional, exploded view of one embodiment of the pouring spout of the instant invention.

Referring now to FIG. 1, there is shown an exploded view of the spout apparatus of the instant invention. In addition, certain portions of the spout are shown partially broken away or partially in section in order to assist in the understanding thereof. In particular, the threaded cap 300 is shown in cross section. The cap 300 is a typical annular-type cap which has an outer surface 301 and an inner surface which is molded or machined to include threads 302. The outer surface can be knurled or otherwise configured for ease of manipulation by the user. The threads 302 are made up in a conventional configuration to mate with the threads on standard containers currently utilized in the industry. These containers may be used to hold antifreeze, oil, brake fluid, or any other similar type of material. While many of these containers are standardized to have a conventional or standard size and thread configuration, other caps 300 can be used with the invention in order to mate with other types of containers.

The opened end of the cap 300 is adapted to receive the threaded mouth or neck of the container. The other end of the cap 300 includes an aperture 304 which is, conventionally, a circularly shaped opening at the end of the cap and adapted to receive the spout body 200 as described hereinafter. The opening 304 is defined to be slightly smaller than the inner diameter of the cap whereby an internal should 305 is provided at the edge of the opening 304. The shoulder 305 operates to retain the spout body 200.

The funnel end or closure cap 100 is adapted to engage the other end of the spout body 200. The closure cap 100 includes, in this embodiment, a relatively large diameter, substantially cylindrical portion 102 and a relatively small diameter, substantially cylindrical portion 101. The cylindrical portions 101 and 102 are joined together by a tapered section 103. A plurality of fins 104 or other protuberances extend from the outer surface of the larger portion 102 of the cap 100. These fins are in the nature of a knurled finish or the like n order to permit ease of manipulation of the closure cap 100.

A cam-follower 105 is provided on the inner surface of the larger cylindrical portion 102. In point of fact, a pair of diametrically opposed cam-followers 105 may be incorporated in the cap 100. The cam-followers may take the form of a pin or small bump on the inner surface of the closure cap portion 102.

The main spout body 200 is a slightly arcuate, hollow, substantially cylindrical, tube-like arrangement. The tube 201 may curve through an arc of approximately 23.5°, for example. Of course, this dimension is a representation and not limitative. At one end of the tube 201 is a lip 208. The lip 208 has a flat inner edge and a rounded outer edge. This configuration permits the lip 208 to traverse the opening 304 in cap 300 and to be, effectively, captured therein by the relatively flat surface of shoulder 305.

A plurality of fins or vanes 207 extend outwardly from the outer surface of the arcuate tube 201. The vanes 207 provide structural strength for the spout body and, as well, an easy means for grasping the device.

At the other end of the arcuate tube 201 is a so-called "stopper end" 250 which includes a cylindrical unit which has substantially the same inner diameter as the tube 201. The outer diameter of the stopper end of spout body 200 can be slightly larger than the outer diameter of arcuate tube 201. (This arrangement is not required, however.) A sealing ring 204 extends radically outwardly from the surface of a stopper end of the spout body 200. The sealing ring 204 is arranged to abut with and form a seal against the inner surface of portion 102 of the closure cap 100. In addition, a cam-slot 203 is provided in the outer circumference of the stopper end 250. The cam-slot 203 does not pass all the way through the stopper end 250. The cam slot 203 is, essentially, symmetrical around the circumference of the stopper end 250. Thus, two high points 203A are provided on opposite sides of the cylinder 250. Likewise, two low points 203C are provided on opposite sides of the cylinder 250 but are spaced equi-distant from the high points 203A. The respective high and low points are connected by sloped or angled connecting grooves 203B. The high and low points also comprise relatively flat segments to provide a latching apparatus for the cam follower 105 in closure cap 100.

Figure 4:
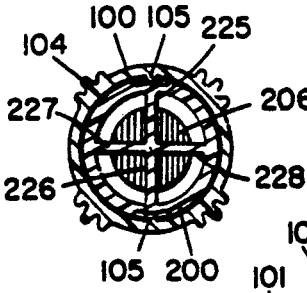
FIG. 4 is a sectional view of the cap-end of the spout taken along the lines 4—4 in FIG. 2.

A stopper 206 in the form of a disk is mounted to appropriate ribs 225, 226, 227 and 228. (Rib 228 is not visible in FIG. 1 but is shown in FIG. 4.) The ribs 225-228 extend outwardly from the cylinder 250 of closure cap with a step-down portion adjacent to the stopper 206. The ribs or vanes 225, 226, 227 and 228 are relatively thin vanes which extend into the cylinder 250. However, these vanes are arranged to not impede, in any substantial fashion, the flow of materials through the spout.

Preferably, the material for the spout is made of a high impact, relatively strong, plastic material such as polyethylene. The stopper cap 206 is arranged to have a slight degree of flexibility so as to better conform to the tapered inner surface of the closure cap 100. This will permit a better seal in the "off" or "closed position". However, the material must have a substantial degree of "resilience" or "memory" so that the stopper 206 will not be permanently deformed.

Figure 2:
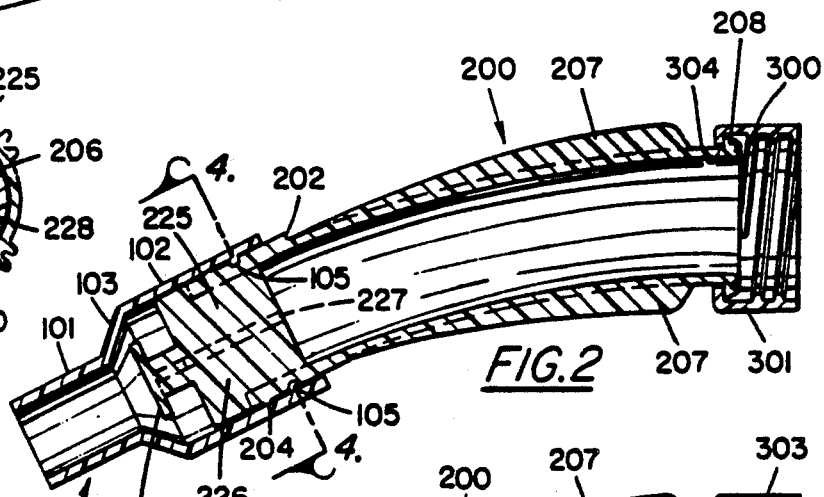
FIG. 2 is a fully assembled, cross-sectional view of the pouring spout of the instant invention in the "open" position.

Referring now to FIG. 2, there is shown a cross-sectional view of the apparatus in the assembled condition. A cross-sectional view is provided in order to demonstrate the inner connection, for example, of the cap 300 with the body 200. In particular, the lip 208 is shown to interact and interlock with the opening 304 and shoulder 305 in the cap 300. However, the cap 300 is free to rotate around the end of the spout body 200.

At the other end of the spout body 200, the closure cap 100 is mounted with the cam-followers 105 engaged, as shown, in the cam-groove 203. In particular, as shown in FIG. 2, i.e. the "open position", the cam-followers 105 are disposed in the high point 203A of the cam-groove. Thus, closure cap 100 is spaced forwardly with respect to the spout body 200. The ribs 225, 226, 227 and 228 (shown dashed) provide a counting arrangement for the stopper 206, but provide ample space therearound for the materials to pass through the spout and through the closure cap 100.

Figure 3:
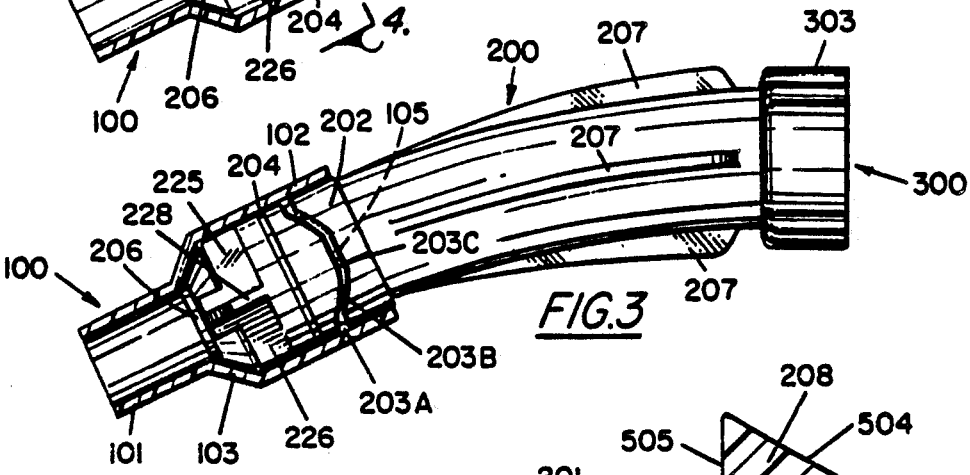
FIG. 3 is a fully assembled, partially broken away, partially sectional view of the pouring spout of the instant invention in the "closed" position.

Referring now to FIG. 3, the spout is shown in the "closed" position. In this case, the closure cap 100 has been turned or rotated approximately 90°. The cam-follower 105 has followed the cam-groove 203 and rests in the low point 203C. This arrangement has the effect of drawing the closure cap 100 onto the end of spout body 200. The dimensions of the cam-groove 203 are arranged so that the closure cap 100 is moved and the tapered sides 103 move into contact with the stopper 206. The relative dimensions of the stopper 206, the tapered side 103, and the inner diameter of the small end 101 of closure cap 100 operate to block the flow of the materials through the closure cap (and, thus, the pouring spout).

It is clear that the cam followers 105 will remain in the low points 203C of the cam-groove until overtly and positively moved to the high point position 203A. Until so moved, the stopper cap 206 has blocked the flow of materials through the pouring spout.

This operation of the spout can be accomplished easily, even while material is flowing through the spout, by merely rotating the closure cap 100. Suitable indicia can be used to indicate the position of closure cap 100 in the "full open" or "full closed" position. This indicia can take the form of lines or grooves in the body of the spout, if so desired.

Referring now to FIG. 4, there is shown a cross-sectional view of the stopper end of the spout and the closure cap 100 taken along the lines 4—4 in FIG. 2. Thus, the cylindrical configuration of the cap 100 with the ribs or vanes 104 extending therefrom is clear. The cam-followers 105 which extend outwardly are also shown. The stopper 206 is shown mounted on the ribs 225, 226, 227 and 228. These ribs are shown to intersect in a cruciform arrangement to permit maximum flow space therearound.

Figure 5:
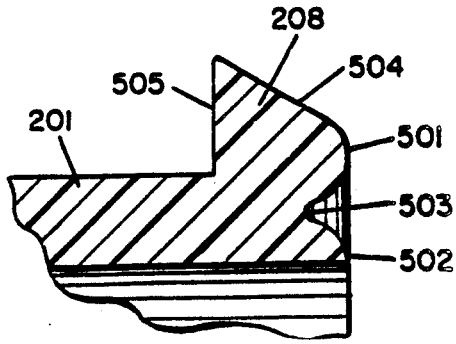
FIG. 5 is a detailed showing of the double-lip edge of the spout body shown in FIG. 1.

Referring now to FIG. 5, there is shown a detailed arrangement of one embodiment of the lip 208 shown in FIGS. 1 and 2. In this embodiment, the edge of lip 208 includes a dual or double arch portion.

In particular, the lip extends from the body 201 which is shown in fragmentary view. The cross-sectional arrangement shows the angled edge 504 which permits the end of the spout body 200 to be easily and readily inserted into the opening 304 in the cap 300. The flat surface 505 is arranged to abut against the inner surface of shoulder 305 of cap 300 to prevent the separation of the cap 300 and the spout body 200. The other surface of the lip 208 includes a pair of arcuate surfaces 501 and 502 joined together by a depression 503. This edge or lip arrangement permits the arcuate surface of the edge 208 to readily accommodate and be separately compressed by different sizes or configurations of containers which are threadedly engaged by the cap 300.

That is, some containers on the market have a relatively straight or flat surface at the outer edge of the threaded neck while some containers have a relatively bevelled or angled surface at the outer edge surface. These container end surfaces require different types of receiving surfaces in order to form a leakproof seal. By using the "double-arch" surfaces 501 and 502, either of the kinds of bottles or containers noted above can be utilized with the spout of the instant invention.

Referring now to FIGS. 6–9, another preferred embodiment of the present invention is illustrated which differs from the one previously described in that the cam surface is on the closure cap or funnel shaped member and the cam follower is on the tubular body member or spout body. Features or elements of the embodiment of FIGS. 6–9 which are the same as those of the embodiment of FIGS. 1–5 are identified by the same reference numeral primed.

Figure 7:
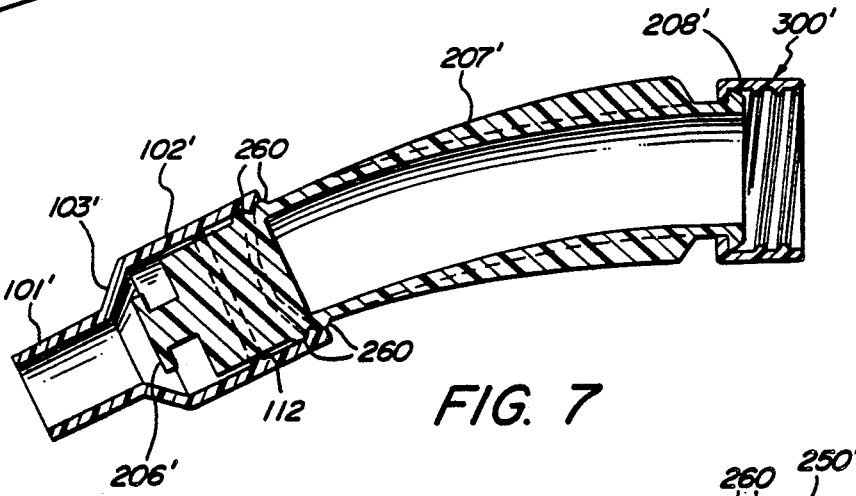
FIG. 7 is a fully assembled cross-sectional view of the pouring spout of FIG. 6 in the "open" position.
Figure 9:
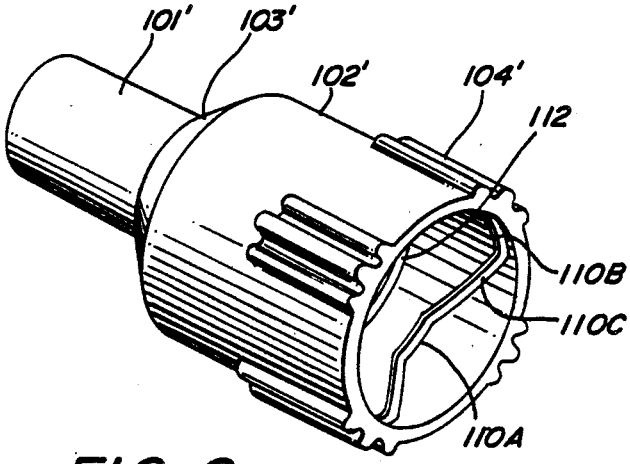
FIG. 9 is an enlarged perspective view of the closure cap of the spout of FIG. 6.
Figure 8:
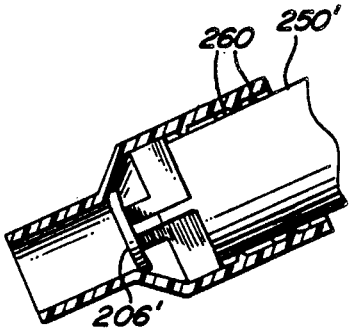
FIG. 8 is a cross-sectional view of the outlet end of the spout of FIG. 6 in the "closed" position.

The cylindrical inner surface of the funnel shaped member 100' defines a continuous radially inwardly projecting cam surface 110 in the form of a raised track. The cam track 110 includes two high points 110A on opposite sides of the inner surface of the funnel shaped member and two low points 110C spaced equi-distance (i.e., at 90°) from the high points 110A. The respective high and low points are connected by sloped or ramped track portions 110B. The high and low points also comprise flat segments to provide a latching action for a cam follower on the tubular member to be described. A sealing ring 112 in the form of a radially inwardly extending surface on the funnel shaped member 100' abuts and forms a seal with the outer surface of the tubular body member 200 as is best illustrated in FIG. 7.

Figure 6:
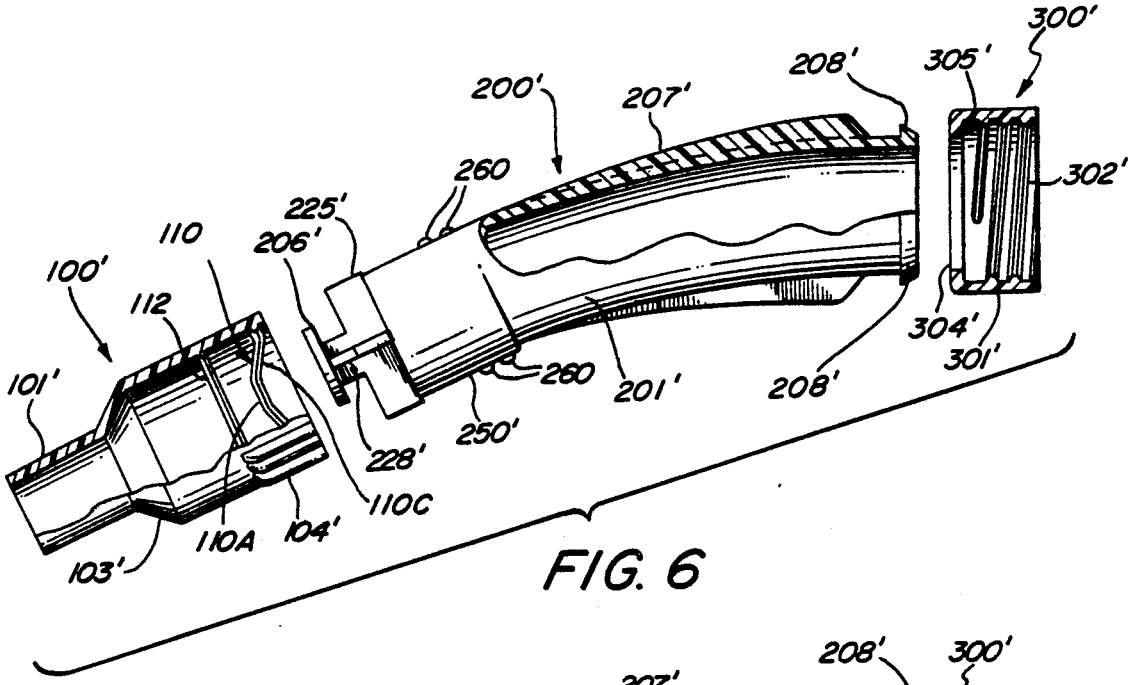
FIG. 6 is a partially broken away, partially sectional view of another embodiment of the present invention.

A cam follower in the form of two pair of small projections or bumps 260 formed on opposite sides of the cylindrical unit or stopper end 250' of the tubular body member 200' as is illustrated in FIG. 6. The projections 260 straddle the cam track 110 so that when the funnel shaped member 100' is rotated in one direction until the cam follower is at the high point 110A of the cam track 110 the stopper 206' will close the spout (FIG. 8) and when the funnel shaped member is rotated in either direction from the closed spout position the spout will be opened as is illustrated in FIG. 7.

The embodiment of FIGS. 6–9 particularly lends itself to injection molding technology. The use of the raised cam track 110 on the funnel shaped member 100' allows that member to be readily stripped from a male mold without distortion of the cam surface. A groove on a male member such as the cam groove 203 on tubular body member 200 is more difficult to produce by injection molding techniques.

Thus, there is shown and described unique configurations of a selective pouring spout. The spout can be operated to be turned "on" (to pass material therethrough) or turned "off" (to prevent the flow of materials therethrough). The particular configurations shown and described herein are directed to preferred embodiments of the instant invention. While this description is directed to such particular embodiment, it is understood that those skilled in the art may conceive modifications and/or variations to the specific embodiments shown and described herein. Any such modifications or variations would fall within the purview of this description are intended to be included therein as well. It is understood that the description herein is intended to be illustrative only and is not intended to be limitative. Rather, the scope of the invention described herein is limited only by the claims appended hereto.

We claim:

1. A sealable pouring spout adapted to be releasably secured to an oil container or the like comprising:

a) a tubular body member having an attachment end and a pouring end, the attachment end defining an annular lip extending outwardly from the body member and the pouring end having a cylindrically shaped outer surface portion;

b) a connector member rotatably mounted on the attachment end of the tubular body member and extending over the lip thereof, the connector member defining threads adapted to engage complementary threads on the container; and c) a funnel shaped member rotatably mounted on the tubular body member adjacent the pouring end thereof, the funnel shaped member including a rear cylindrical section having a cylindrically shaped inner surface which surrounds the tubular body member adjacent the pouring end thereof, a front cylindrical section of smaller diameter than the pouring end of the tubular body member and a tapered section joining the front and rear sections, the funnel shaped member further having an outlet end through which material to be dispensed from the container flows;

d) the cylindrically shaped inner surface of the funnel shaped member defining an inwardly projecting cam surface extending circumferentially about the tubular body member from at least one high point to at least one low point, the low point being positioned at a greater distance from the pouring end of the tubular body member than the high point, the tubular body member outer surface defining a cam lobe follower riding on said cam surface so that rotation of the funnel shaped member in either direction relative to the tubular body member causes the outlet end of the funnel shaped member to move toward and away from the pouring end of the tubular body member; and e) the tubular body and funnel shaped members having cooperating closure means comprising a stopper member mounted on the pouring end of the tubular body member for sealingly engaging the tapered section of the funnel shaped member when the outlet end of the funnel shaped member is moved toward the pouring end of the tubular body member the maximum distance allowed by the cam surface and the cam lobe follower.

2. The pouring spout of claim 1 wherein the cam surface includes at least one relatively flat segment for causing the cam lobe follower to latch the closure means in the fully closed position.

3. The pouring spout of claim 2 wherein one of the funnel shaped and tubular body members includes a sealing ring for engaging the other of said members at a location spaced from the cam surface to prevent passing of materials through the pouring end of the tubular body member from along the exterior surface of the tubular body member toward the attachment end thereof.

4. The pouring spout of claim 3 wherein the cylindrically shaped inner surface of the funnel shaped member includes the sealing ring in the form of an annular inwardly projecting surface located closer to the pouring end of the member than the cam surface.

5. The pouring spout of claim 2 wherein the stopper member is a resilient disc.

6. The pouring spout of claim 4 wherein the tubular body member includes a plurality of ribs which secure the resilient disc, the ribs permitting the flow of materials through the tubular member, over the resilient disc and through the funnel shaped member when the closure means is open.

7. The pouring spout of claim 4 wherein at least one high point comprises two diametrically opposed high points and wherein at least one low point comprises two diametrically opposed low points, and wherein the low points are separated from the high points by 90 degrees so that the funnel shaped member is rotated through about 90 degrees to close the pouring end of the tubular body member from its fully open position and vice versa.

8. The pouring spout of claim 2 wherein the cam follower comprises a pair of diametrically opposed projections extending outwardly from the outer surface of the tubular body member.

9. A sealable pouring spout adapted to be releasably secured to an oil container or the like comprising:

a) a tubular body member having an attachment end and a pouring end, the attachment end defining an annular lip extending outwardly from the body member and the pouring end having a cylindrically shaped outer surface portion;

b) a connector member rotatably mounted on the attachment end of the tubular body member and extending over the lip thereof, the connector member defining threads adapted to engage complementary threads on the container; and c) a closure cap rotatably mounted on the tubular body member adjacent the pouring end thereof, the closure cap including a rear cylindrical section having a cylindrically shaped inner surface which surrounds the tubular body member adjacent the pouring end thereof, a front cylindrical section of smaller diameter than the pouring end of the tubular body member through which material from the container to be dispensed flows and a tapered section joining the front and rear sections;

d) the cylindrically shaped inner surface of the closure cap defining an inwardly projecting cam track extending circumferentially about the tubular body member from at least one high point to at least one low point, the outer surface of the tubular body member defining a cam lobe follower riding on said cam track so that rotation of the closure cap in either direction relative to the tubular body member causes the front section of the closure cap to move toward and away from the pouring end of the tubular body member; and e) the tubular body member and closure cap having cooperating closure means comprising a stopper member mounted on the pouring end of the tubular body member for sealingly engaging the tapered section of the closure cap when the front section of the funnel shaped member is moved toward the pouring end of the tubular body member the maximum distance allowed by the cam track and the cam lobe follower.

10. The pouring spout of claim 9 wherein the cam track includes at least one relatively flat segment for causing the cam lobe follower to latch the closure means in the fully closed position.

11. The pouring spout of claim 10 wherein the cylindrically shaped inner surface of the closure cap defines an inwardly projecting cylindrical surface spaced from the cam track for engaging the cylindrically shaped outer surface of the tubular body member to prevent passing of materials through the pouring end of the tubular body member from along the exterior surface of the tubular body member toward the attachment end thereof.

12. The pouring spout of claim 10 wherein the stopper member is a resilient disc.

13. The pouring spout of claim 12 wherein the tubular body member includes a plurality of ribs which secure the resilient disc, the ribs permitting the flow of materials through the tubular member, over the resilient disc and through the funnel shaped member when the closure means is open

14. The pouring spout of claim 13 wherein at least one high point comprises two diametrically opposed high points and wherein at least one low point comprises two diametrically opposed low points, and wherein the low points are separated from the high points by 90 degrees so that the funnel shaped member is rotated through about 90 degrees to close the pouring end of the tubular body member form its fully open position and vice versa.

* * * * *

UNITED STATES PATENT AND TRADEMARK OFFICE

CERTIFICATE OF CORRECTION

PATENT NO. : 5,067,639

DATED : Nov. 26, 1991

INVENTOR(S) : Paul R. Maguire and John M. Lown

It is certified that error appears in the above—identified patent and that said Letters Patent is hereby corrected as shown below:

Column 1, line 67, after "frequently" insert --.--.

Column 2, line 15, after "body" insert --.--.

Column 3, line 62 "n" should read --in--.

Signed and Sealed this

Sixth Day of April, 1993

*Attest:*

STEPHEN G. KUNIN

*Attesting Officer*

*Acting Commissioner of Patents and Trademarks*